United States Patent [19]

Blomdahl

[11] Patent Number: 4,986,829

[45] Date of Patent: Jan. 22, 1991

[54] EAR PIERCING DEVICE

[75] Inventor: Karl Blomdahl, Harplinge, Sweden

[73] Assignee: Lars Blomdahl AB, Halmsad, Sweden

[21] Appl. No.: 246,549

[22] PCT Filed: Jan. 21, 1988

[86] PCT No.: PCT/SE88/00016

§ 371 Date: Aug. 31, 1988

§ 102(e) Date: Aug. 31, 1988

[87] PCT Pub. No.: WO88/05273

PCT Pub. Date: Jul. 28, 1988

[30] Foreign Application Priority Data

Jan. 21, 1987 [SE] Sweden ..... 8700236

[51] Int. Cl.[5] ..... A61B 17/34

[52] U.S. Cl. ..... 606/188; 63/13

[58] Field of Search ..... 128/329 R, 330, 334 C; 63/12, 13; 24/103, 104, 108; 411/373, 437, 521, 527; 606/185, 188

[56] References Cited

U.S. PATENT DOCUMENTS

| | | | |
|---|---|---|---|
| 3,943,935 | 3/1976 | Cameron | 606/188 |
| 4,030,507 | 6/1977 | Mann | 128/330 |
| 4,164,224 | 8/1979 | Hastings | 128/330 |
| 4,513,746 | 4/1985 | Aranyi et al. | 128/334 C |
| 4,631,929 | 12/1986 | Hollingworth | 63/13 |

*Primary Examiner*—C. Fred Rosenbaum
*Assistant Examiner*—William Lewis

[57] ABSTRACT

Ear piercing device comprising a pin 1 intended to pierce the ear by means of a quick motion, and a fastener which is intended to be secured to the one end of the pin. At its opposite end the pin exhibits a widened portion 8. The fastener has an opening which is intended to be penetrated by the end of the pin, in addition to which the fastener exhibits an end stopper for the pointed end in the shape of a counterbore located directly opposite the opening in such a way that the edges of the opening are brought into contact with the pin and the pin is slowed to a stop by means of its one end coming against the end stopper in the fastener when the pointed end is inserted into the counterbore.

2 Claims, 3 Drawing Sheets

EAR PIERCING DEVICE

TECHNICAL FIELD

The present invention relates to an ear piercing device comprising a piercing pin intended to pierce the ear with a high velocity by means of a piercing pistol and a rear piece, carried by the piercing pistol and having an opening, the rear piece being intended to receive the forward end of the pin and to arrest the motion of the pin and to hold it securely, the opening of the retaining or rear piece being intended to be penetrated by the end of the pin.

TECHNICAL PROBLEM

The prevalent technique for piercing ears for earrings consists of shooting a piercing pin through the ear by means of a piercing pistol and securing it in a rear piece which is held by the pistol on the other side of the ear. A piercing pin is shot through the ear lobe and against the rear piece with relatively high velocity. This movement must be stopped when the pin is at a certain position relative to the ear lobe. With pins according to the prior art, the forward part of the pin was narrower than the rear part. The rear piece was formed with a hole arranged to receive only the forward part of the pin, whereby the pin was stopped in the hole, since it was not large enough to receive the rear part of the pin. It has been possible to choose this design when using pins of metal, but it is not satisfactory for use with pins made of, e.g., polymer materials. Metal can however lead to hypersensitivity reactions in the wearer polymer materials have proved to be very suitable in these situations.

The object of the present invention is to provide a device in which the piercing pin, which is shot at high velocity into the rear piece, may be made of a different material than metal so that it is stopped and held securely in the correct position in the rear piece.

THE SOLUTION

Said object is achieved by means of the device in accordance with the present invention, which is characterized in that the rear piece exhibits an end stopper for the forward end of the pin located directly in front of said opening in such a way that the end stopper is arranged to constitute a stop surface for the forward end of the pin, by means of which the pin is slowed to a stop when the pointed end is inserted into the counterbore.

Figure 1:
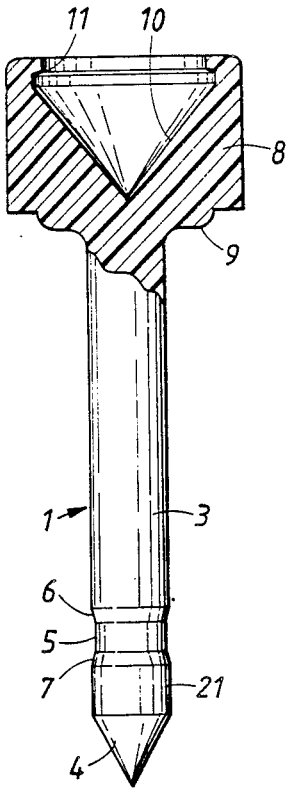
Figure 2:
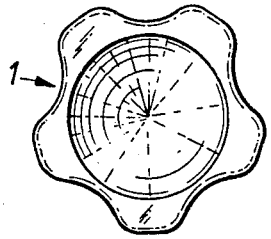
Figure 3:
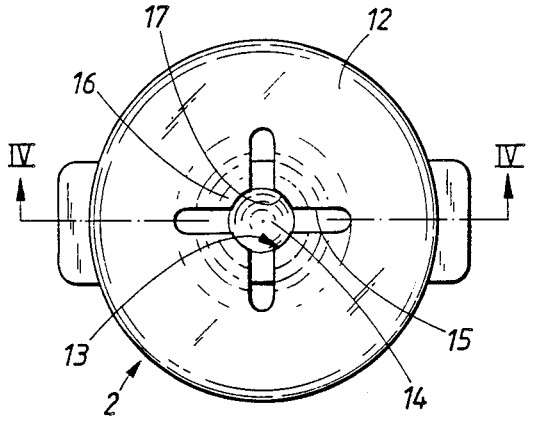
Figure 4:
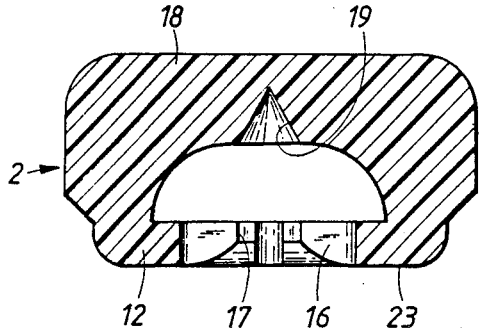

The invention will be described in greater detail below using an exemplifying embodiment with reference to the accompanying drawings, in which FIG. 1, on a greatly enlarged scale, shows a partially broken view of a pin included in the device according to the invention; FIG. 2 is an end view of the pin; FIG. 3 is a view of a rear piece included in the device; FIG. 4 is a sectional view through the rear piece along the line IV—IV in FIG. 3; and FIG. 5 is a view of the device with the pin secured in the rear piece.

As is seen in the figures, the device according to the invention consists of two main members, namely, a pin 1 and a rear piece 2. The pin exhibits a generally cylindrical, longitudinally extending portion 3 with a pointed forward end 4 having a suitably conic form. Located near the pointed end 4, and spaced from it, a waist portion 5 is provided, i.e., a portion having a somewhat smaller diameter than the diameter of the rest of the cylindrical portion 3. Transition between the thicker cylindrical portion 3 and the mainly cylindrical waist portion 5 is provided by conical bevels 6, 7. At the opposite end, relative to the pointed end 4, a widened portion 8 is provided having a supporting surface 9 for contact against the ear around the hole made in the ear. The widened portion 8 has a recess 10 intended to form a setting for an ornamental stone or the like. The setting is mainly conical with an annular flange 11 which permits setting the stone without the need for adhesive; rather, the stone may be held securely by means of snapping action.

The rear piece 2 exhibits a disc portion 12 with an opening 13 which has a central portion 14 which permits passage of the pin 1, as well as crossing slits 15, so that protruding locking wings 16 with locking edges 17 are formed, which are intended to cooperate with the outer surface of the pin 1 in a manner which will be described below. The locking edges 17 preferably have the shape of circular arcs with a radius of curvature which is generally equal to or somewhat less than the radius of curvature of the waist portion 5. The central portion 14 thus has advantageously a diameter which is somewhat less than the diameter of the waist portion 5. The locking edges 17 of the opening 13 form a disassembly catch, which secures the rear piece to the pin.

Figure 5:
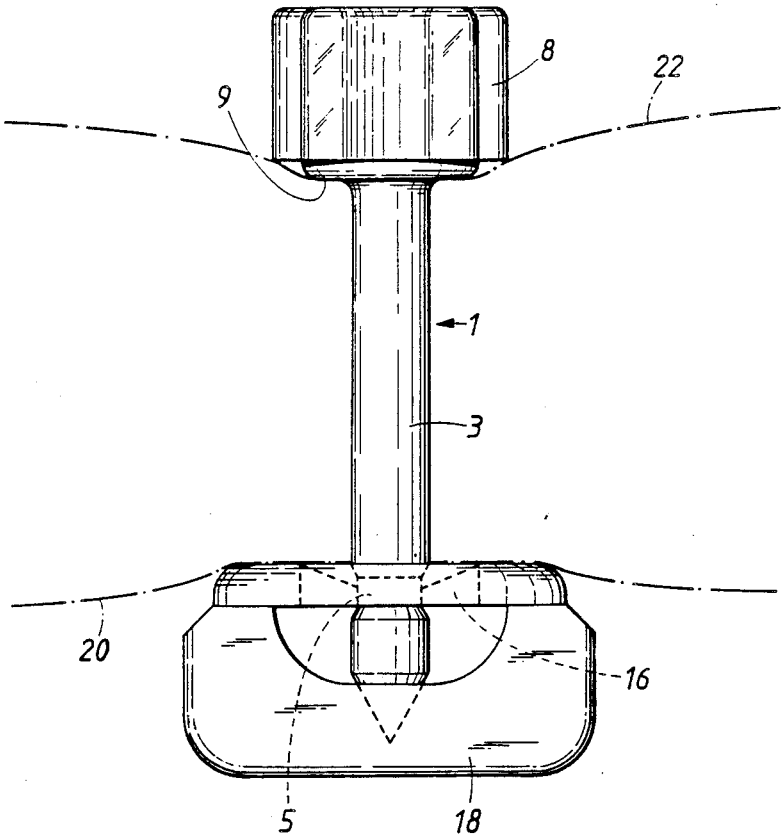

The rear piece 2 also exhibits a bridge portion 18 formed as a unit with the disc portion 12, the appearance of the bridge portion being seen best in FIGS. 4 and 5. Directly in front of the central portion 14 of the opening 13, the bridge portion has a conical counterbore 19, the shape and dimensions of which are adapted to the pointed end 4 of the pin 1. Furthermore, the bridge portion 18 is formed in such a way that the counterbore 19 is located at a distance from the locking wings 16, the distance mainly corresponding to the distance between the waist portion 5 and the conical end 4. The counterbore constitutes an essential portion of the invention and it forms an end stopper which, as the pointed portion of the pin impacts the end stopper, brings the motion of the pin to a stop. This is described further below.

The device according to the invention is particularly suitable for being formed of a non-allergenic material which is gentle to the skin, such as a polymer material, e.g., polycarbonate or the like. By choosing the dimensions of the wall thickness of the plastic material suitably, the locking wings 16 may therefore be made elastically resilient.

Piercing an ear, a portion 20 of which is indicated schematically in FIG. 5, is done in the following manner. The two main members of the device, the pin 1 and the rear piece 2, are for example placed in a conventional ear piercing pistol, with the rear piece being placed in an immovable receiving part and the pin in a moving part, whereupon the pistol is placed so that the receiving part is placed against the back side of the ear lobe directly adjacent to the place where the hole in the ear is to open, whereby the pin is shot in a known manner by means of the pistol against the ear so that the pointed end 4 of the pin 1 pierces the ear, thus creating a hole in it. When the pointed end 4 of the pin exits the ear, the point is inserted centrally through the central portion 14 in the opening 13, whereupon the conical outer surface of the pointed end 4 comes into contact with the locking edges 17 and bends the locking wings 16 slightly out of the way. The opening 13 is thus enlarged somewhat by the locking edges 17, i.e., the edges of the opening, being bent against the stopper. Upon further insertion of the pin through the opening 13, the locking edges 17 will slide against the forward portion 21 of the cylindrical portion between the waist 5 and the pointed end 4 and, when the waist portion 5 reaches the locking edges 17, the locking wings 16 will partially swing back since the locking edges 17 slide along the conical bevel 7 and along the cylindrical outer surface of the waist portion 5. At the same time, the pointed end 4 is inserted into the conical counterbore 19 and impacts its wall, whereupon the motion of the pin is slowed and stopped. The counterbore (and not, as is the case of solutions according to the prior art, the waist portion 5 of the pin) of the bridge portion 18 thus forms a stopper. The waist portion 5 can therefore be given a relatively large diameter, which is advantageous from the point of view of structural strength when using plastic. The length of the cylindrical portion 3 between the waist portion and the widened portion 8 is chosen so as to generally correspond to the thickness of a normal ear, so that the supporting surface 9 of the widened portion 8 comes to rest against the outside 22 of the ear, whereas the front side 23 of the disc portion 12 of the rear piece 2 will form a supporting surface against the inside of the ear around the hole made in the ear.

FIG. 5 shows the device in its mounted state in the ear, with the hole having been made, whereby it serves as an earring during an initial period, during which the hole made in the ear may heal. The pin is locked securely in the rear piece 2 and is prevented from separating by means of the locking action provided by the locking wings 16 by means of the locking edges 17 bearing against the cylindrical outer surface of the waist 5. Since the locking wings will not have returned completely, very reliable locking is achieved since the traction forces which strive to separate the rear piece from the pin lead to an increased clamping force between the locking edges 17 and the outer surface of the waist portion, at the same time as the guiding of the pointed end 4 into the counterbore 19 stabilizes the secureness of the holding by the rear piece 2 of the pin so that there is no risk that the rear piece will become asymmetrically skewed.

The rear piece 2 can of course be removed when a sufficiently large traction force is applied to the rear piece to cause a sufficient deformation of the locking wings 16. The invention is not limited to the exemplifying embodiment described above and shown in the drawings, but rather it may be varied within the scope of the following patent claims. The slits 15 may for example possibly be deleted and replaced by locking edges 17 which are themselves so elastic that they allow the cylindrical portion to penetrate and that they provide locking in a corresponding manner. Furthermore, the bridge portion 18 may be rotationally symmetric in relation to the disc portion 12 so that a completely closed rear piece is obtained. The setting 10 may be replaced by completely different arrangements for securing some ornamental object, such as hanging jewelry or the like. The waist portion 5, which is included in the disassembly catch, is not actually necessary, but rather locking may be accomplished even using a pin lacking a waist portion because of the great surface pressure of the locking edges against the outer surface of the pin, which provides friction locking.

What is claimed is:

1. An ear piercing device comprising a piercing pin and a retaining piece, said retaining piece being positionable between the earlobe and the head of a person, said retaining piece is provided with retaining means including locking edges around the opening, said locking edges being capable of bending towards the retaining piece and of resiliently contacting peripheral surfaces of the piercing pin when the pin is inserted into the opening, said piercing pin being provided with a pointed forward end, able to pierce the earlobe, said retaining piece having an opening and a counter bore, able to receive and hold the forward end of the piercing pin, said counterbore having a bottom surface forming an end stopper for the pointed forward end of the piercing pin, said piercing pin having a waist portion near the pointed forward end, but at a distance therefrom, and located such that when the forward end of the piercing pin comes to a stop against the end stopper, the locking edges of the opening of the retaining piece fasten tightly around said waist portion, the opening of said retaining piece having a number of slits directed outwardly from a central portion having a circumference which is smaller than the circumference of the pin, at a location between the waist portion and the pointed forward end of the pin, said piercing pin and retaining piece being capable of attaining:

(a) an initial positioning mode, wherein said piercing pin and retaining piece are positioned at opposite sides of the earlobe in a chosen position where a hole is to be made in the earlobe, (b) a piercing mode, wherein the piercing pin is given a high velocity by a force acting on the piercing pin in a direction towards the earlobe and the retaining piece, whereby said piercing pin pierces the earlobe and moves with its forward end through the opening into the counterbore of the retaining piece, and (c) a final positioning mode, wherein the piercing pin has been slowed down to a stop by means of striking with its forward end against the bottom surface of the counterbore and wherein the piercing pin is retained in the retaining piece.

2. A device according to claim 1, wherein the retaining piece comprises a disc portion having the opening and a bridge portion integral with the disc portion, said counterbore being in said bridge portion and having a shape corresponding to the shape of the forward end of the piercing pin.

* * * * *